US006279481B1

(12) United States Patent
Schippers

(10) Patent No.: US 6,279,481 B1
(45) Date of Patent: Aug. 28, 2001

(54) DEVICE FOR PROVOKING THE COLLAPSE OF SNOW CORNICE

(76) Inventor: Jacob Schippers, Z. I. Le Bresson / F -, 38660 Le Touvet (FR)

( * ) Notice: Subject to any disclaimer, the term of this patent is extended or adjusted under 35 U.S.C. 154(b) by 0 days.

(21) Appl. No.: 09/446,239

(22) PCT Filed: Jun. 22, 1998

(86) PCT No.: PCT/IB98/00971

§ 371 Date: Dec. 17, 1999

§ 102(e) Date: Dec. 17, 1999

(87) PCT Pub. No.: WO99/00637

PCT Pub. Date: Jan. 7, 1999

(30) Foreign Application Priority Data

Jun. 26, 1997 (FR) ..... 97 08245

(51) Int. Cl.[7] ..... F24D 3/00
(52) U.S. Cl. ..... 102/302; 102/301; 89/1.1
(58) Field of Search ..... 102/439, 205, 102/334, 7, 302, 1.811; 89/1.811, 1.812, 1.1–1.4

(56) References Cited

U.S. PATENT DOCUMENTS 2,459,854 * 6/1949 Swift .
4,353,301 * 10/1982 Jacobsen .
5,107,765 4/1992 Schippers ..... 102/302
5,872,326 * 2/1999 Manhart .

FOREIGN PATENT DOCUMENTS

798536 * 1/1997 (AT) .

* cited by examiner

*Primary Examiner*—Charles T. Jordan
*Assistant Examiner*—Troy Chambers
(74) *Attorney, Agent, or Firm*—Davis & Bujold, P.L.L.C.

(57) ABSTRACT

The invention concerns a device for provoking the collapse of a snow cornice comprising several exploders (11). Each exploder (11) consists of a main cylinder (12), perpendicular to the support base (14) arranged flat on the ground, and a positioning tube (13) connected to the main cylinder and mounted on a rigid seat (15) fixed to the mountain side. A supply conduit (20), connected by conduits (23, 24) respectively to an oxygen cylinder and a propane cylinder stored in a shelter (22), supplies via conduit sections (9) a detonating gas mixture, obtained from two gases, into the positioning tube (13) and into the main cylinder (12). Igniting means (21) mounted upstream of the supply conduit (20) ensure the ignition of the detonating gas mixture.

8 Claims, 5 Drawing Sheets

DEVICE FOR PROVOKING THE COLLAPSE OF SNOW CORNICE

FIELD OF THE INVENTION

The present invention concerns a device for provoking the collapse of a snow cornice, said device comprising at least one gas exploder.

BACKGROUND OF THE INVENTION

Devices which provoke the collapse of snow cornices are known in the art, consisting of a gas gun attached to the side of a mountain with its base solidly anchored in a seating consisting of a concrete block and its mouth opening above the snow cover, such as described in U.S. Pat. No. 5,107,765. These guns are designed to provoke avalanches in exposed areas, for example, above ski stations or inhabited areas. The devices are very effective in provoking avalanches in zones known as avalanche corridors, that is, areas consisting primarily of steeply sloped gorges where snow accumulates rapidly and may attain unstable critical masses. They have proven particularly effective on light snow that is not dense and has a high volume of air trapped inside the snow crystals. The movement triggered by detonation provokes a wave effect with strong initial compression, followed by a slower movement that breaks up the snow cover and raises the mass of snow enough to provoke an avalanche. However, in areas where a thick crust is forming rapidly, the action of the explosion above the stabilized, dense snow layer and the shock wave propagated in the air are not sufficient to break the snow cover and trigger an avalanche.

Furthermore, these devices need to be anchored rigidly and very solidly to a mountain side, specifically, by means of a concrete seating anchored to rock. It may be difficult to position such a base on a steep area, or where there is limited access or crumbling rock. This is the often the case along cornices where snow may accumulate on an outcropping and where the rocky base is not always suitable for supporting a reinforced concrete seating for an avalanche-provoking gun as defined above. Moreover, cornices may be quite long and the crest, which defines the extent of snow movement in avalanches, may stretch for dozens or even hundreds of meters. In this case it would be necessary to install several guns in order to effectively provoke an avalanche, thereby compounding the difficulties already enumerated.

SUMMARY OF THE INVENTION

The present invention proposes a resolution to these problems and offers an attractive, effective solution to the difficulties described above. It does not harm the environment, and eliminates the risk of triggering an uncontrolled avalanche in exposed locations where other known methods are unsuitable or ineffective.

This goal is achieved by the device wherein the exploder consists of one main cylinder which is essentially perpendicular to a support base placed flat on the ground, a positioning tube connected to the main cylinder and mounted on a rigid seat attached to the side of the mountain, a supply conduit furnishing explosive gas mixture to the positioning tube and the main cylinder, and ignition means located upstream of the supply conduit for igniting the explosive gas mixture.

According to one preferred embodiment, said positioning tube is articulated to said rigid base on a generally horizontal axle.

According to a particularly advantageous embodiment, the supply conduit is designed to convey the explosive gas mixture and at least one spark plug is attached to said conduit to ensure that the explosive gas is ignited.

The supply conduit is preferably connected to two flexible conduits which are respectively connected to reservoirs of oxygen and combustible gas.

According to a preferred embodiment, the spark plug is connected to an ignition system consisting of a pressostat associated with a dual-state microswitch, a condenser, an electric battery, and an igniter, said microswitch providing communication between the condenser and the igniter when in the first state, and between the condenser and the battery when in the second state.

The device advantageously comprises several exploders and the supply conduit comprises several interconnected portions, arranged so that the distance between the connection zone and the exploders is the same for all the exploders so that simultaneous explosions can be provoked.

It is preferable for the main cylinder seating to be made of concrete equipped with a rubber plate to cushion the fall of the cylinder.

The main cylinder advantageously has a hollow cylindrical body and an air evacuation outlet. The cylindrical body is preferably surmounted by a mass at the upper extremity.

BRIEF DESCRIPTION OF THE DRAWINGS

The present invention will be better understood with reference to the description of a preferred embodiment and to the attached drawings, provided by way of non-limiting examples, in which.

DESCRIPTION OF THE PREFERRED EMBODIMENTS

Figure 1:
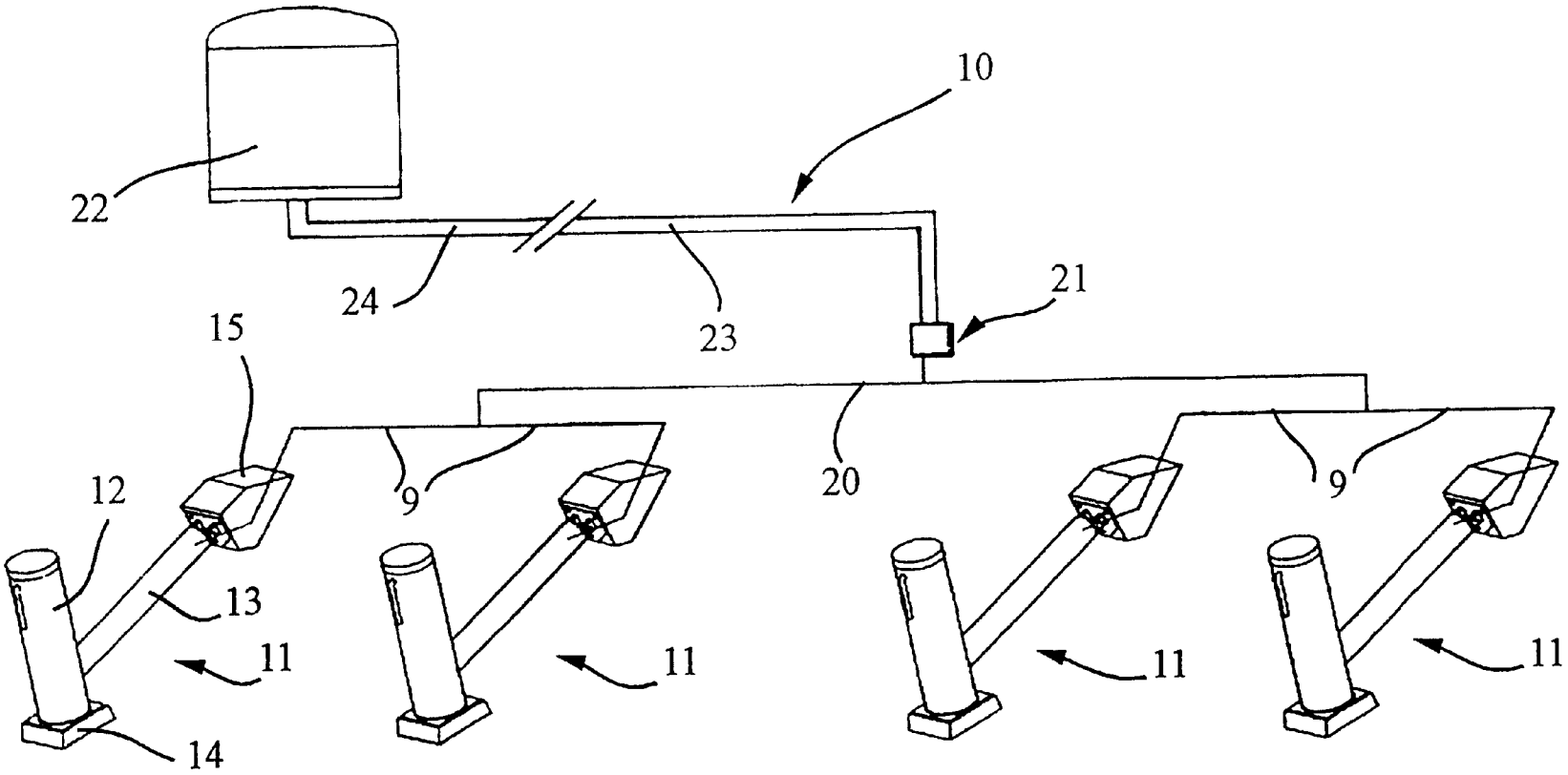
FIG. 1 is a general perspective of a preferred embodiment of the device of the invention comprising several gas exploders for equipping a site near a cornice.
Figure 2:
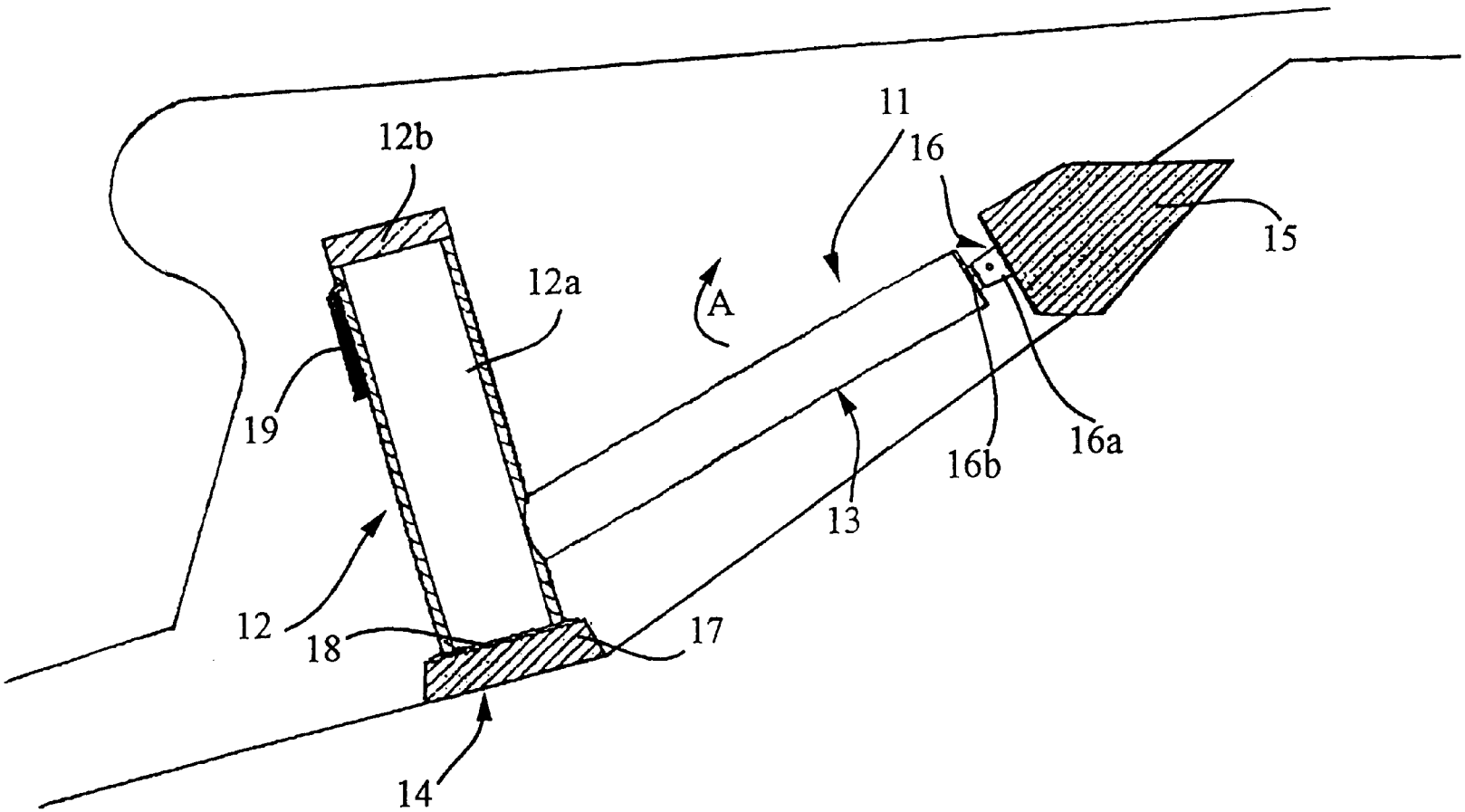
FIG. 2 is a vertical cross-section of one of the exploders placed at an appropriate site.
Figure 3:
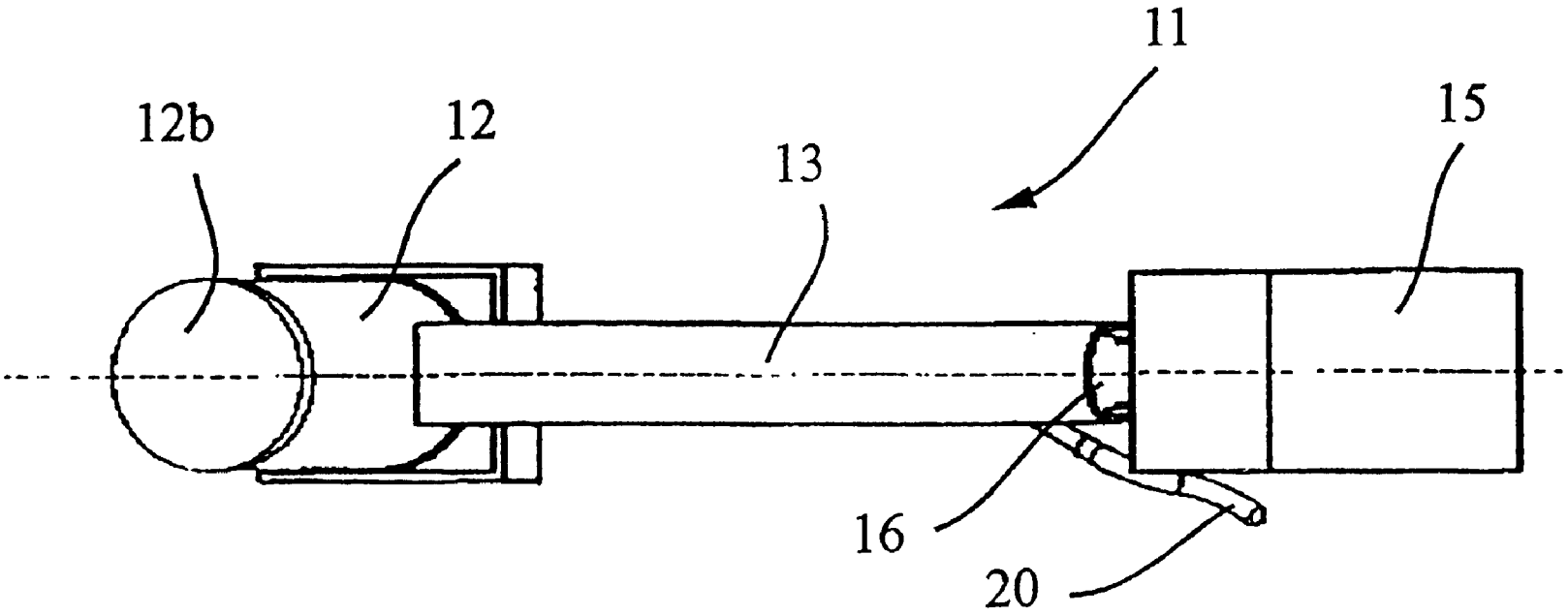
FIG. 3 is a plane view of the exploder of FIG. 1.

With reference to FIGS. 1, 2, and 3, device 10 comprises several exploders 11, each having a main cylinder 12 and a tube 13 for positioning the explosive mixture. Main cylinder 12 is generally perpendicular to a support base 14 positioned flat on the ground and positioning tube 13 is mounted on a rigid seat 15 attached to the side of the mountain. Positioning tube 13 is connected to main cylinder 12 and joined to rigid seat 15 by an articulation 16 allowing both the positioning tube and the main cylinder to which it is attached to be displaced in the direction of arrow A. The main cylinder consists of a hollow cylindrical body 12*a* open at the base and surmounted at the top by a mass 12*b* acting as a counterweight. Support base 14 consists of a concrete layer 17 covered by a rubber plate 18 which absorbs the shock when the unit consisting of the main cylinder and the positioning tube drops onto it after firing. Rigid seat 15 consists of a concrete block anchored solidly to the mountain, which supports one element 16*a* of articulation 16, while a complementary element 16*b* of said articulation is integral with positioning tube 13. Main cylinder 12 is provided with an air evacuation or bleed conduit 19 during injection of the gas mixture, attached near the upper extremity of hollow cylindrical body 12*a*.

Figure 5:
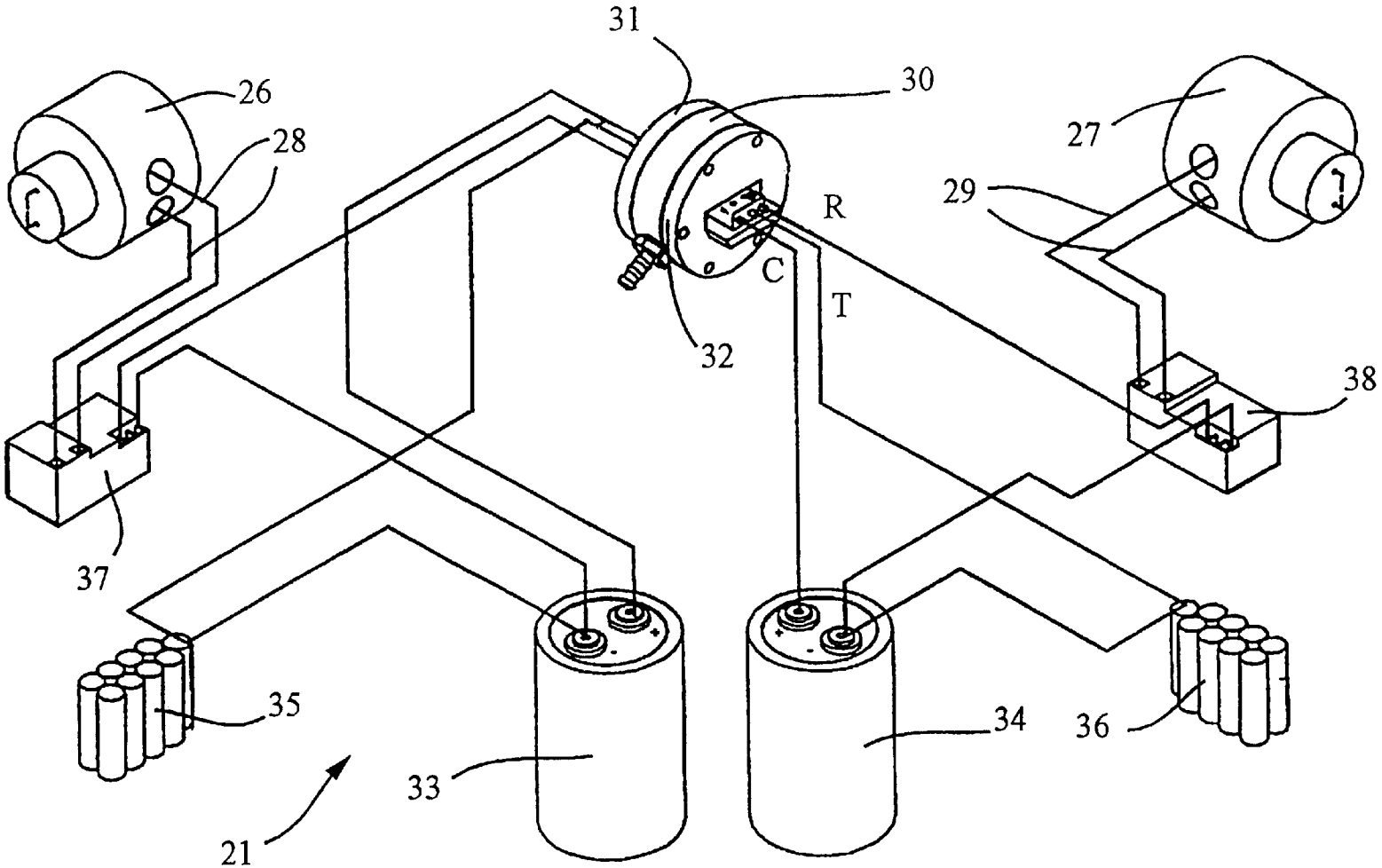
FIG. 5 is a detailed view of the ignition system.

This unit, which constitutes a sort of explosive hammer, is designed to lift up to allow detonated gas to escape, which creates gas pressure in the cornice raising about 10 to 15 $m^2$ of cornice. It is completed by a conduit 20 for supplying the explosive gas mixture, made of steel or a high pressure, flexible material, and an ignition means 21, which floats in order to avoid problems with lightning, and which will be described in more detail with reference to FIG. 5. In the example shown, the device comprises four exploders 11 connection by elements 9 comprising a flexible portion at the connection to the exploder, at supply conduit 20 connected to ignition means 21 shown by a rectangular box. Note that these conduit portions 9 are designed to be the same length, regardless of the exploder. This arrangement is adopted so that the distance separating the igniting box from the exploders is the same for all the exploders, thus allowing all the explosions to occur simultaneously and produce the optimum effect. Said conduit portions are preferably made of steel to resist explosion from the time of ignition to point of the final gas explosion in positioning tube 13 and main cylinder 12. A flexible high pressure element between exploder 11 and supply conduit 20 provides enough flexibility for the hammer to lift.

Reserve bottles of gas, or more specifically at least one bottle of oxygen and one bottle of a combustible gas such as propane, are stored in a suitable housing 22, which also shelters the remote control devices to open the gas valves during detonation. Two flexible conduits 23 and 24, which may be polyethylene, are respectively connected to the oxygen and propane tanks serving as buffer tanks for dispensing the gas into a mixer shown in FIG. 4, upstream of the ignition box containing ignition means 21. These buffer tanks are connected to their respective bottles by means of on/off valves which provide optimum pressure regulation within the tanks.

Figure 4:
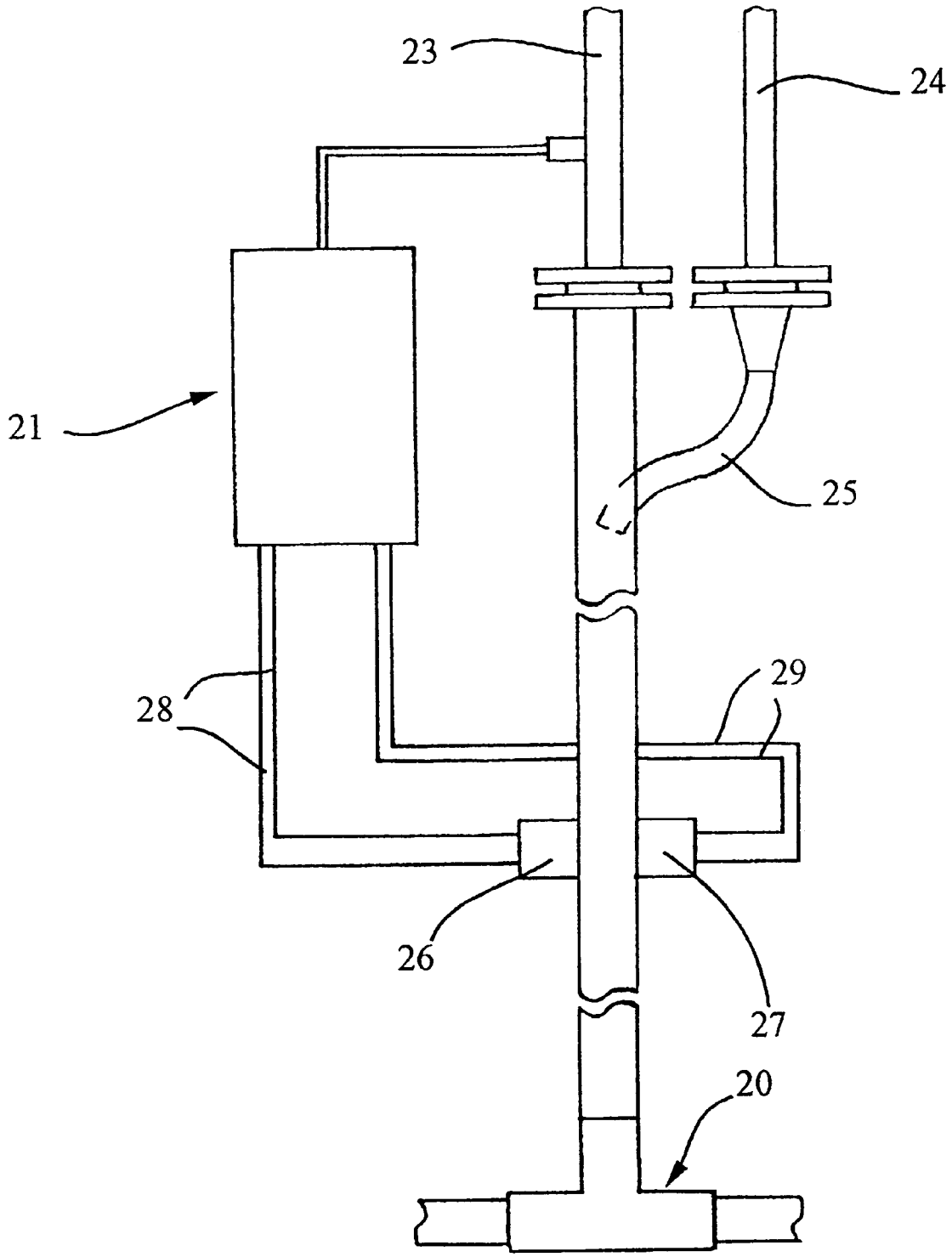
FIG. 4 is an enlarged view of a detail of the device of the invention, showing in particular the location of the junction of the conduits and the ignition box.

FIG. 4 shows in more detail the area where conduits and 23 and 24 connect. These two conduits connect to a larger diameter conduit element. Conduit 23, the oxygen supply conduit, opens straight into supply conduit 20, while conduit 24, the propane supply conduit, is connected to conduit 20 by means of flexible element 25 or a double angled pipe. Below this connection zone there are at least one, preferably two, spark plugs 26 and 27, which are supplied with electricity by two pairs of electrical wires 28 and 29, respectively. These electrical wires are also connected to ignition means 21.

Said ignition means 21 consists of a pressostat 30 controlling two dual state microswitches 31 and 32 with three output terminals, viz.: terminal C, called the common output; terminal T, called the working terminal; and terminal R, called the resting terminal. The ignition means further comprises, in the example shown where two spark plugs 26 and 27, respectively, are provided to ignite the explosive gas, two condensers 33 and 34, two batteries or storage cells 35 and 36, and two igniters 37 and 38. Pressostat 30 is either linked to supply conduit 20 with a small flexible element, or attached directly to said conduit.

Microswitches 31 and 32 are dual state switches. The first state, called the at-rest state, occurs when there is no gas circulating in the conduits and no pressure within pressostat 30. Thus, condensers 33 and 34 are in a closed circuit with igniters 37 and 38, while the battery/condenser circuits remain open. The second state, called the working state, occurs when one of the two gases circulating inside the conduits creates slight pressure in pressostat 30, causing microswitches 31 and 32 to change from the at-rest state to the working state. Since batteries 35 and 36 are then connected in a closed circuit to condensers 33 and 34 and the condenser/igniter circuit is open, the condensers become charged while the gas is being injected.

Once the injection of gases into exploder 11 is complete, pressure on the membrane of pressostat 30 becomes null and microswitches 31 and 32 return to the at-rest state, closing the condenser/igniter circuit and opening the battery/condenser circuit. Each condenser then discharges completely into the corresponding igniter, causing a series of sparks to occur on the sparkplug involved for about 4 to 5 s. The microswitches remain in this state until the next gas injection.

The purpose of submerging these exploders in the cornice is to break it up and possibly cause it to collapse by triggering an avalanche. As soon as they are detonated, the exploders lift up, freeing the detonated gases, and the pressure of the gases lifts the snow cornice and pulverizes it. Displacement of the exploders is made possible by the fact that the positioning tube is articulated. When the main cylinder is raised, pressurized gas escapes from the base, which destabilizes the snow cover. The mass surmounting the main cylinder limits upward displacement and causes the exploder to fall back down onto the seating. The shock of this fall is absorbed by the rubber cushion. If the procedure fails, it can be attempted again several more times.

In a variation of the embodiment, the mass surmounting the cylinder and serving as a counterweight may be weaker; in this case, the cylinder is designed to compensate for the weight difference. It is also possible to provide one ignition system for each exploder.

What is claimed is:

1. A device for provoking collapse of a snow cornice, the device comprising:

at least one gas exploder (11) comprising:

a support base (14) having a bottom surface for resting against a ground surface and a top surface supporting a main cylinder (12) extending substantially perpendicular to the support base (14);

a rigid seating (15) for attachment to a side of a mountain and a hollow positioning tube (13) having a first end mounted to the rigid seating (15) and a second opposed end connected to the main cylinder (12);

a supply conduit (20) communicating with the positioning tube (13) for supplying a mixture of an explosive gas to the main cylinder (12) via the positioning tube (13), an upstream end of the supply conduit (20) being connected to a first flexible conduit (23) for connection to a source of oxygen and to a second flexible conduit (24) for connection to a source a combustible gas; and an ignition system (21) attached to the supply conduit, adjacent the upstream end of the supply conduit, for igniting the explosive gas mixture when desired;

wherein the first end of the positioning tube (13) is articulated to the rigid seating (15) about a generally horizontal axis.

2. The device for provoking the collapse of a snow cornice according to claim 1 wherein the ignition system comprises at least one sparkplug (26) communicating with the supply conduit for igniting the explosive gas mixture.

3. The device for provoking the collapse of a snow cornice according to claim 2, wherein the ignition system (21)

further comprises a pressure controller (30) associated with a duel-state microbreaker (31), a condenser (33) and an igniter (37), and the duel-state microbreaker (31), the condenser (33) and the igniter (37) all are electrically connected to an electric battery (35), the microbreaker (31) providing communication between the condenser and the igniter, when in a first state, and providing communication between the condenser and the battery, when in a second state.

4. A device for provoking collapse of a snow cornice, the device comprising:

a plurality of gas exploders (11), each of the plurality of gas exploders (11) comprising:

a support base (14) having a bottom surface for resting against a ground surface and a top surface supporting a main cylinder (12) extending substantially perpendicular to the support base (14);

a rigid seating (15) for attachment to a side of a mountain and a hollow positioning tube (13) having a first end mounted to the rigid seating (15) and a second opposed end connected to the main cylinder (12);

a supply conduit (20) communicating with the positioning tube (13) of each of the plurality of gas exploders (11) for supplying a mixture of an explosive gas to the main cylinders (12) of the plurality of gas exploders (11) via the positioning tubes (13), an upstream end of the supply conduit (20) being connected to a first flexible conduit (23) for connection to a source of oxygen and to a second flexible conduit (24) for connection to a source a combustible gas; and an ignition system (21) attached to the supply conduit, adjacent the upstream end of the supply conduit, for igniting the explosive gas mixture when desired;

wherein the first end of the positioning tube (13) is articulated to the rigid seating (15) about a generally horizontal axis; and the supply conduit (20) has a down stream portion comprising a conduit branch element (9) connected with each of the plurality of gas exploders (11), the conduit branch element is arranged such that a distance between the ignition system (21) and the plurality of gas exploders (11) is the same for each one of the plurality of gas exploders (11) in order to provoke simultaneous explosions in each of the plurality of gas exploders (11).

5. The device according to claim 1, wherein the support base (14) for the main cylinder (12) is concrete and has a rubber plate (18) located between the top surface of the support base and the main cylinder (12).

6. The device according to claim 1, wherein the main cylinder (12) comprises a hollow cylindrical body (12*a*) and an air evacuation conduit (19).

7. The device according to claim 6, wherein the cylindrical body (12*a*) has a cover which closes an upper extremity of the main cylinder (12).

8. A device for provoking collapse of a snow cornice, the device comprising:

at least one gas exploder (11) comprising:

a support base (14) having a bottom surface for resting against a ground surface and a top surface supporting a main cylinder (12) extending substantially perpendicular to the support base (14);

a rigid seating (15) for attachment to a side of a mountain and a hollow positioning tube (13) having a first end mounted to the rigid seating (15) and a second opposed end connected to the main cylinder (12);

a supply conduit (20) communicating with the positioning tube (13) for supplying a mixture of an explosive gas to the main cylinder (12) via the positioning tube (13), an upstream end of the supply conduit (20) being connected to a first flexible conduit (23) for connection to a source of oxygen and to a second flexible conduit (24) for connection to a source a combustible gas; and an ignition system (21) attached to the supply conduit, adjacent the upstream end of the supply conduit, for igniting the explosive gas mixture when desired;

wherein the first end of the positioning tube (13) is articulated to the rigid seating (15) about a generally horizontal axis; and the ignition system comprises at least one sparkplug (26) communicating with the supply conduit for igniting the explosive gas mixture.

* * * * *